US005441352A

United States Patent [19]

Shiota

[11] Patent Number: 5,441,352

[45] Date of Patent: Aug. 15, 1995

[54] PRINT TAPE FORMING APPARATUS HAVING TAPE CUTTING MECHANISM

[75] Inventor: Junji Shiota, Nagoya, Japan

[73] Assignee: Brother Kogyo Kabushiki Kaisha, Nagoya, Japan

[21] Appl. No.: 306,900

[22] Filed: Sep. 16, 1994

[30] Foreign Application Priority Data

Sep. 22, 1993 [JP] Japan ..... 5-236821

[51] Int. Cl.[6] ..... B41J 11/70

[52] U.S. Cl. ..... 400/621; 101/227

[58] Field of Search ..... 400/185, 187, 593, 621, 400/668; 101/226, 227, 288

[56] References Cited

U.S. PATENT DOCUMENTS 5,232,297 8/1993 Kitazawa ..... 400/621
5,348,406 9/1994 Yoshiaki et al. ..... 400/621

FOREIGN PATENT DOCUMENTS 118173 1/1985 Japan ..... 400/185
259962 6/1986 Japan ..... 400/185
227363 9/1988 Japan ..... 400/185
2-56666 4/1990 Japan .
281979 11/1990 Japan ..... 400/621
284962 12/1991 Japan ..... 400/185
265770 9/1992 Japan ..... 400/593

*Primary Examiner*—Ren Yan
*Attorney, Agent, or Firm*—Oliff & Berridge

[57] ABSTRACT

A tape cutting device includes a fixed blade fixed to a frame and a movable blade fixed to a manually pivotable lever. A printing operation to the print tape is performed by a print head and a platen. In this case, the tape runs by the rotation of the press roller and a tape feed roller, those being driven by a driving motor 2 through a power transmitting portion including a gear train. A gear of the gear train is associated with a tape cutting prevention mechanism including a stop lever. When the tape printing operation is carried out, the stop lever is movable to a first pivot position where the manually pivotable lever is abuttable on the stop lever to prevent the manually pivotable lever to be angularly rotated. When the tape is to be cut, the stop lever is moved to a second pivot position offset from the manually pivotable lever. Thus, the movable blade can be moved toward the fixed blade to cut the tape.

14 Claims, 3 Drawing Sheets

PRINT TAPE FORMING APPARATUS HAVING TAPE CUTTING MECHANISM

BACKGROUND OF THE INVENTION

The present invention relates to a print tape forming apparatus having a tape cutting mechanism, and more particularly, to such apparatus capable of performing a printing operation on a tape accommodated in a tape cassette while drawing out the tape from the cassette, and capable of cutting the tape at a predetermined length after printing is made thereon.

A print tape forming apparatus of this type is disclosed in Japanese Utility Model Application Kokai No. 2-56666. According to the publication, a tape cassette has spools for each winding thereover a transparent print tape formed of a synthetic resin, an ink ribbon, and a double-side adhesive tape which is temporarily attached to a peelable tape at one side thereof. This cassette is loadable into a print tape forming apparatus.

A lamination type print tape forming apparatus is proposed which includes a print head such as a thermal head or the like, a platen, and a feeding means for feeding out the tape to the outside of the cassette. Image data such as character data, etc. to be printed are beforehand input in the print tape forming apparatus, and on the basis of a print instruction the transparent print tape is printed with mirror images corresponding to the image data along a longitudinal direction of the tape while feeding out the tape by the actuation of the feeding means. The double-side adhesive tape is adhesively attached to a printed surface of the tape.

A receptor type print tape forming apparatus is also proposed in which an ink ribbon, a print tape of synthetic resin and an adhesive tape are accommodated in a cassette. The print tape is beforehand adhesively attached to one surface of the adhesive tape which has the other surface temporarily adhesively attached with a peelable tape. Alternatively a heat-sensitive coloring print tape is adhesively attached to one surface of an adhesive tape having the other surface temporarily adhered with a peelable tape. Such heat-sensitive print tape and the adhesive tape are accommodated in a cassette without accommodation of the ink ribbon. Printing is performed by a print head while feeding the print tape.

The above described print tape forming apparatus is normally provided with a manual cutting device for cutting the printed tape at a predetermined length. In such a conventional apparatus, an operator may inadvertently manipulate the manual cutting device during a printing operation, so that the tape running is disturbed by a blade portion, which in turn results in unwanted tape winding around the feeding means, or insufficient running of the ink ribbon.

In order to eliminate this drawback, there has been proposed a mechanism for stopping the feeding means or stopping the printing operation when the tape is cut. That is, a cutting device includes a fixed blade and a movable blade which is pivotally movable toward and away from the fixed blade. An operation lever is provided to the movable blade, and is pivotally movable by pushing an operation button against urging force of a spring. Further, a cutter actuation detecting sensor is provided in association with the operation lever. When the movable blade is moved toward the fixed blade for providing tape cutting state, the sensor is actuated to stop the feeding means and cease the printing operation.

However, even with this construction, a tape which has been printed and fed out may be accidentally cut at a halfway portion of the printing area, or the non-printed zone of the print tape may be largely provided due to interception of the printing operation. In addition, the provision of the sensor increases production cost.

SUMMARY OF THE INVENTION

It is therefore, an object of the present invention to provide an improved cutting device for a print tape forming apparatus, the cutting device having a simple arrangement and being capable of ensuring tape feeding during printing operation and avoiding undue wastage of the tape.

This and other objects of the present invention will be attained by providing a print tape forming apparatus including a frame, feeding means, printing means, cutting means and means for preventing the cutting means from being moved in a cutting direction. The feeding means is supported to the frame for feeding a tape, and the feeding means has a power transmission means rotatable in one direction for feeding the tape in a forward direction for printing and in opposite direction for feeding the tape in a retracting direction. The printing means is supported to the frame for performing a print on the tape when the tape is fed in the forward direction. The cutting means is supported to the frame for manually cutting the tape after printing. The cutting means is movable in a cutting direction for cutting the tape, and movable in a non-cutting direction. The preventing means is provided to prevent the cutting means from being moved in the cutting direction when the tape is fed in the forward direction. The preventing means is supported to the frame and is connected to the power transmission means. The preventing means is movable between a first position in accordance with the rotation of the transmission means in the opposite direction for disengagement from the cutting means and a second position in accordance with rotation of the transmission means in the one direction for engagement with the cutting means.

With this structure, the cutting means becomes inoperable when the tape is fed by the feeding means. Therefore, accidental tape cutting does not occur during printing operation, and the vain use of the tape can be prevented. Since the cutting means does not disturb running of the tape during printing, unwanted tape winding over the tape feed roller does not occur. If an ink ribbon is used, smooth winding of the ink ribbon results because of smooth running of the tape during printing. The preventing means is of a simple arrangement, and does not require a sensor, and therefore, entire production cost can be restrained at low level.

DETAILED DESCRIPTION OF THE PREFERRED EMBODIMENTS

Figure 1:
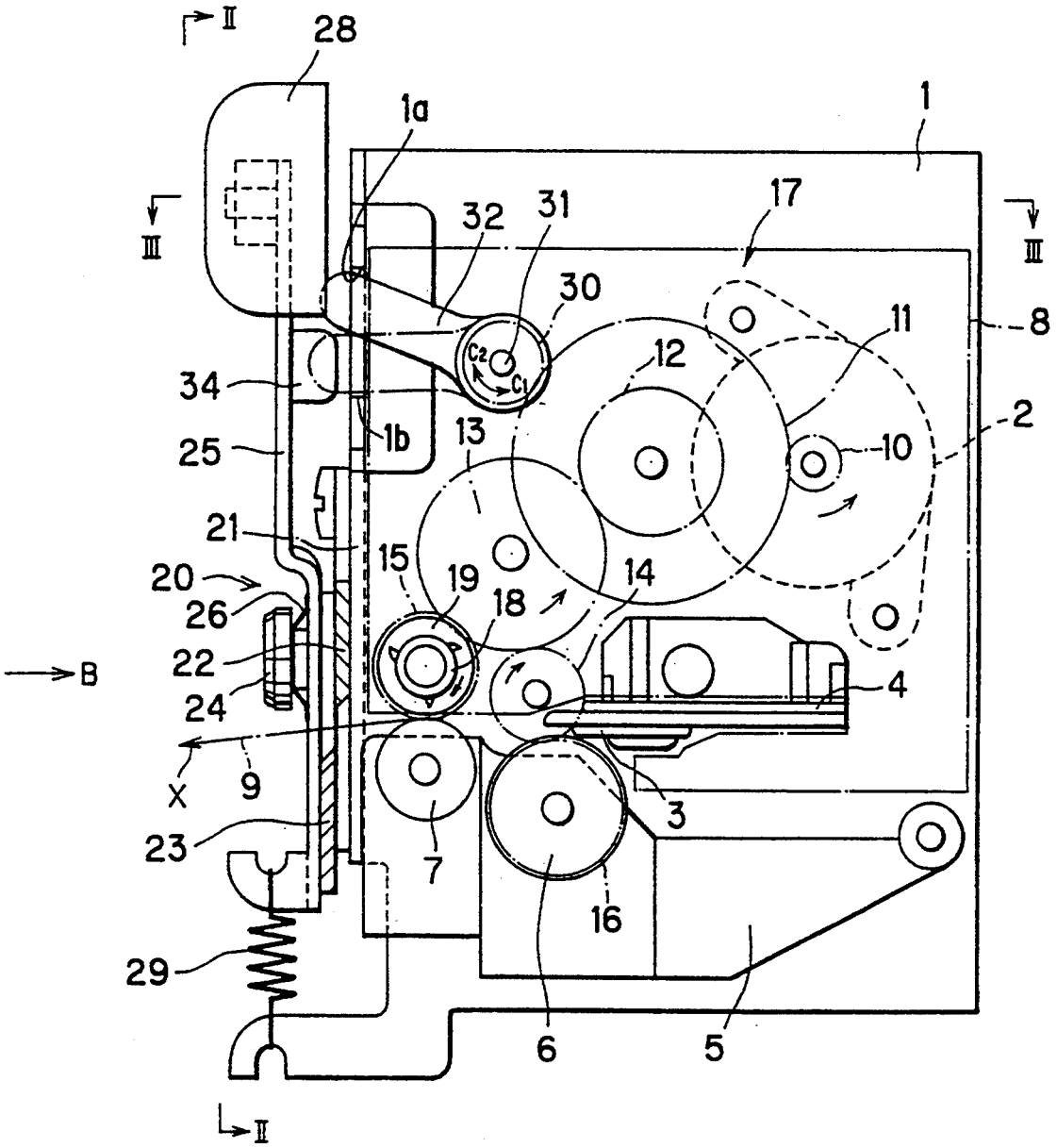
FIG. 1 is a plan view showing a print tape forming apparatus having a tape cutting device according to a first embodiment of the present invention.
Figure 2:
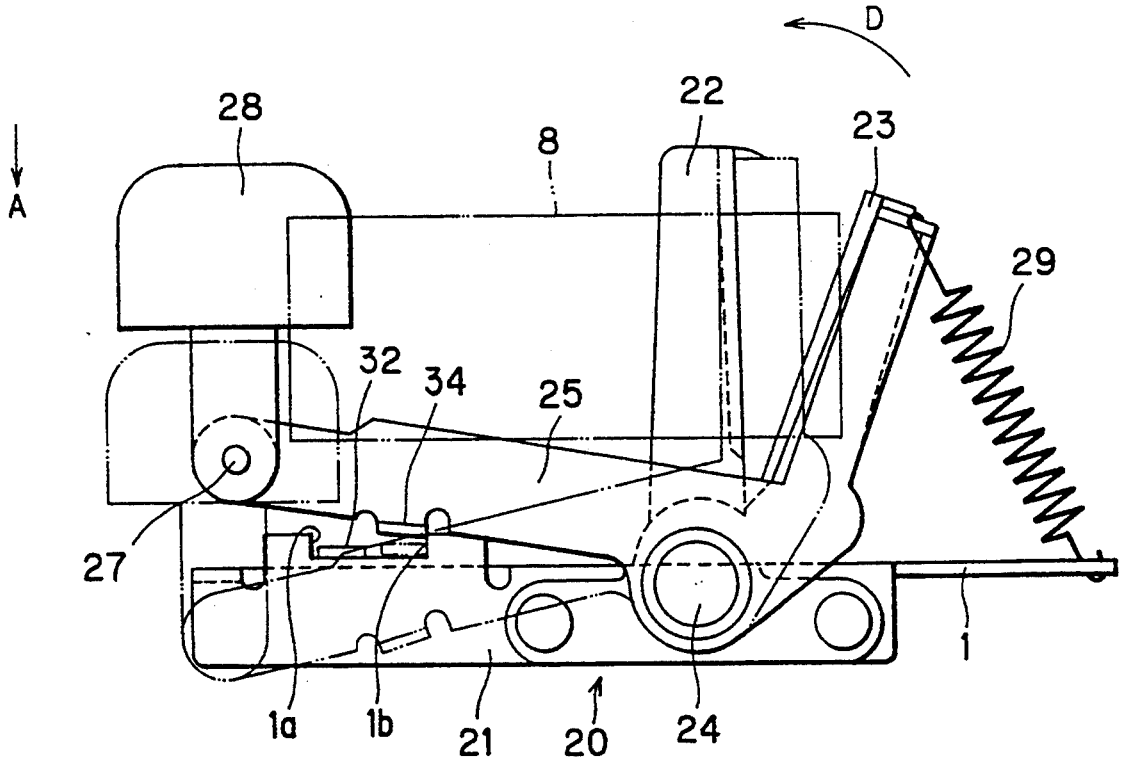
FIG. 2 is a side view taken along a line II—II of FIG. 1.
Figure 3:
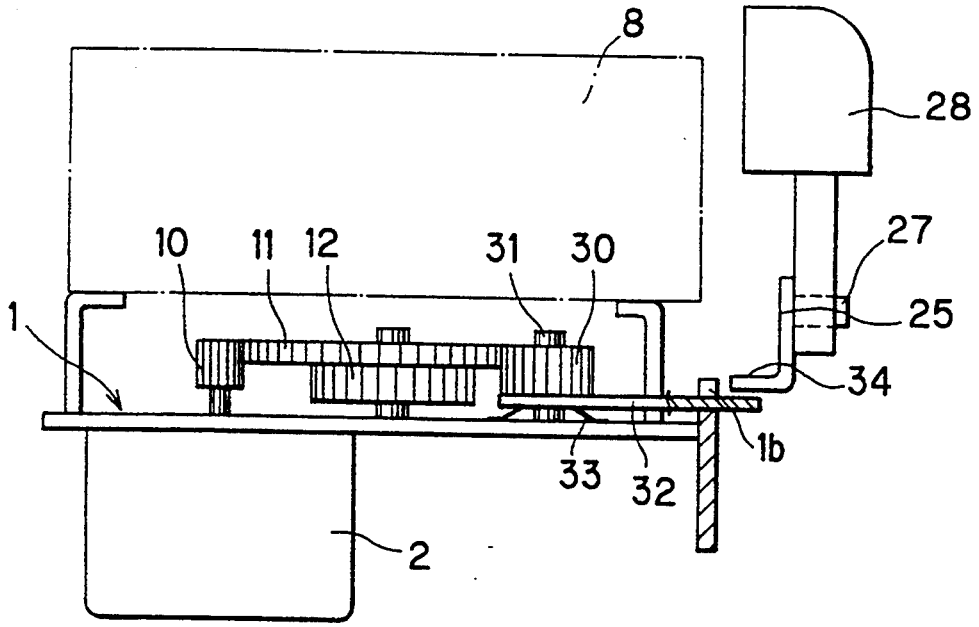
FIG. 3 is a partially-notched side view taken along a line III—III of FIG. 1.

A tape cutting device according to a first embodiment of this invention will be described with reference to FIGS. 1 through 3. FIG. 1 shows a main part of a print tape forming apparatus which includes a frame 1 made of a metal plate. A driving motor 2 is provided to the back surface of the metal frame 1. A cassette 8 (see one-dotted chain line in FIG. 1) is detachably loaded to the front surface side of the frame 1. The cassette 8 includes a tape feed roller 19. On the front surface side, there are provided a bracket 4 and a holder 5. The bracket 4 upstands from the frame 1, and a print head 3 such as a thermal head is fixed to the bracket 4. The holder 5 is angularly movably provided on the front side of the frame 1, and a platen roller 6 and a press roller 7 are rotatably provided to the holder 5. The platen 6 is movable toward and away from the print head 3. The press roller 7 serves as a part of a feeding means for feeding out a print tape 9 in the cassette 8 in X-direction (to the outside of the cassette 8).

The feeding means includes a gear train 17 having plurality of gears 11 to 16 serving as a power transmission portion. The feeding means also includes a tape spool 18 projecting from the front surface side of the frame 1 and provided coaxially and integrally witch the gear 15. The gear 11 is meshedly engaged with a pinion 10 coupled to the drive motor 2 to transfer a motive power to the platen 6 and the spool 18 by way of the gear train 17. An inner surface of the tape feed roller 19 of the cassette 8 is engageable with the tape spool 18 when the cassette 8 is loaded onto the print tape forming apparatus. Thus, rotational power of the driving motor 2 is transmitted to the platen 6 and the tape feed roller 19.

A cutting device 20 will next be described with reference to FIGS. 1 through 3. A rise-up piece 21 is provided at one side portion of the frame 1. A fixed blade 22 is fixedly provided to the rise-up piece 21, and a L-shaped lever 25 is pivotally provided movably around a pivot shaft 24 extending through the rise-up piece 21. The L-shaped lever 25 has one end provided with a pin 27 to which a push button 28 is connected for pivotally moving the L shaped lever 25 in a direction A shown in FIG. 1. The L shaped lever 25 has another end connected to one end of a biasing spring 29 whose another end is connected to the frame 1.

A base end of a movable blade 23 is fixed to the lever 25. A spring washer 26 is interposed between a head portion of the pivot shaft 24 and the lever 25 for elastically pressing the movable blade 23 toward the fixed blade 22 in the direction B. By pushing the push button 28 in the direction indicated by the arrow A of FIG. 2, the movable blade 23 is moved toward the fixed blade 22 in a direction indicated by an arrow D and is engaged therewith against the biasing force of the spring 29, to thus cut the tape 9.

A support shaft 31 extends frontwardly from the front side of the frame 1, and a gear 30 is rotatably supported around the shaft 31. The gear 30 is meshedly engaged with the gear 11 which is a part of the power transmitting portion. Further, one end of a stop lever 32 is rotatably provided to the support shaft 31 at a position immediately below the gear 30. A spring washer 33 is interposed between the one end portion of the stop lever 32 and the frame 1 for pressing the stop lever 32 against the lower surface of the gear 30. Therefore, the stop lever 32 is pivotally movable along with the rotation of the gear 30 because of friction. Another end of the stop lever 32 is abuttable on the L-shaped lever 25, for example on an engagement piece 34 provided to the lever 25. The stop lever 32 serves as an interlocking member for preventing the L-shaped lever 25 from pivotally moving in the direction A when the stop lever 32 engages the engagement piece 34.

The rise-up piece 21 is formed with a recess to define a first stop wall 1*a* and a second stop wall 1*b*. The first stop wall 1*a* is adapted to prevent the stop lever 32 from further moving in a clockwise direction in FIG. 1, and the stop wall 1*b* is adapted to prevent the stop lever 32 from further moving in a counterclockwise direction in FIG. 1. In this connection, the frictional force between the stop lever 32 and the gear 30 and brought by the spring washer 33 is suitably provided so as to allow the gear 30 to be smoothly rotated after the stop lever 32 abuts the stop wall 1*a* or 1*b*, so as to permit the gear 11 to be smoothly rotated.

With this construction, when the printing operation is executed and the tape 9 runs in the X-direction by the feeding means, the gear 11 is clockwisely rotated by the forward rotation of the driving motor 2 in FIG. 1, so that the gear 30 is counterclockwisely rotated (in a direction as indicated by an arrow C1 in FIG. 1). Through this operation, the stop lever 32 is moved in the counterclockwise direction in FIG. 1 because of the friction relative to the gear 30, and is stopped at the second stop wall 1*b*. In this case, the free end portion of the stop lever 32 is brought to a position abuttable against the lower surface of the lever 25 or the lower surface of the engagement piece 34. Accordingly, even if the push button 28 is pressed in the direction A, the lever 25 cannot be pivotally moved because of this abutment. Consequently, the movable blade 23 cannot be moved toward the fixed blade 22. That is, tape cutting cannot be performed when the tape 9 passes through a gap between the movable blade 23 and the fixed blade 22.

When the printing operation is completed or a blank portion of the tape is to be cut, the driving motor 2 is reversely rotated for a short period. Through this operation, the gear 30 is clockwisely rotated (in a direction as indicated by an arrow C1 in FIG. 1), and the stop lever 32 is clockwisely rotated and stopped at the position of the first stop wall 1*a*. As a result, the stop lever 32 is brought to a position where no mechanical interference occurs relative to the lever 25 or the engagement piece 34. Therefore, by pushing the push button 28, the lever 25 can be rotated and thus the tape can be cut.

Figure 4:
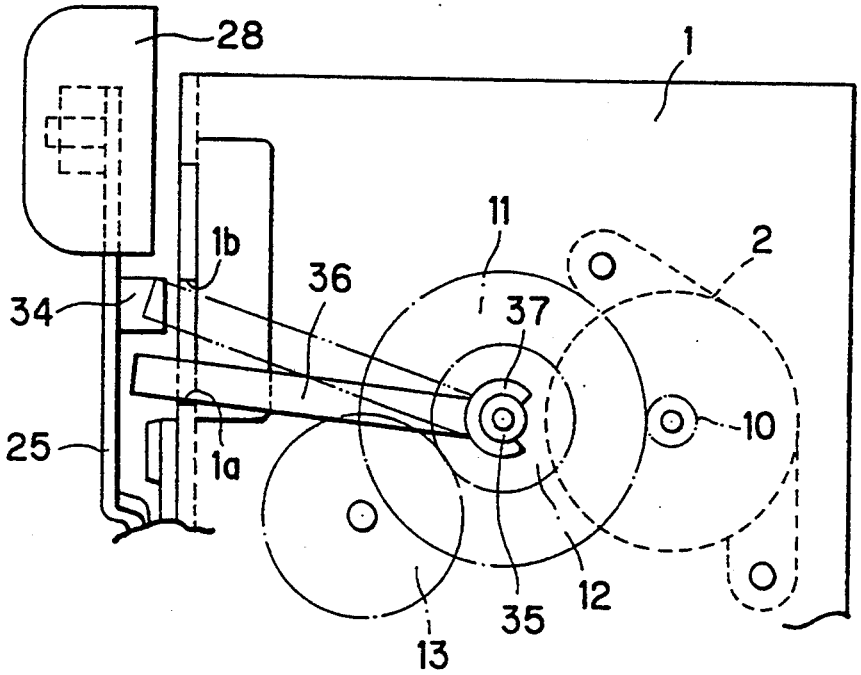
FIG. 4 is a plan view showing an essential portion of a tape cutting device according to a second embodiment of the present invention.

A tape cutting device according to a second embodiment of the present invention is shown in FIG. 4. In the first embodiment, separate gear 30 and the stop lever 32 are provided for abutment with the lever 25. On the other hand, in the second embodiment, a single stop lever 36 is provided for the same purpose. That is, the stop lever 36 has a base portion provided with a bifurcated portion 37 which resiliently pinches on an outer peripheral surface of of a boss portion 35 integrally rotatable with the gear 11. A free end of the stop lever 36 is provided abuttable on the lever 25 or the engagement piece 34 of the lever 25 similar to the first embodiment.

The stop lever 36 can be interlockingly rotated by friction with the rotation of the gear 11. When the driving motor 2 is forwardly rotated to execute the printing operation, the free end portion of the stop lever 36 is interlockingly rotated with the clockwise rotation of the gear 11, and is then abuts the second stop wall 1*b*. Since the driving torque of the drive motor 2 is greater than the frictional force between the boss 35 and the bifurcated portion 37, the gear 11 can be rotatable even after the stop lever 36 abuts the second stop wall 1*b*. In this case, the free end portion of the stop lever 36 is located at a position immediately below the engaging portion 34. Thus, the pivotal rotation of the lever 25, that is, the push-down of the push button 28 can be prevented.

When the cutting work is to be executed, the driving motor 2 is reversely rotated for a short period to rotate the stop lever 36 in the counterclockwise direction in FIG. 4. When the free end portion of the stop lever 36 abuts the first stop wall 1*a*, the free end of the stop lever 36 is brought to a position offset from the engagement piece 34. Thus, the angular rotation of the lever 25 can be permitted to enable the cutting operation.

While the invention has been described in detail and with reference to specific embodiments thereof, it would be apparent to those skilled in the art that various changes and modifications may be made therein without departing from the spirit and scope of the invention. For example, in the illustrated embodiments, the engagement segment 34 is integrally provided to the L-shaped lever 25 for abutment with the free end of the stop lever 25 or 36. However, the engagement piece 34 can be dispensed with, and instead, the free end of the stop lever 36 can be arranged to directly engage the lower surface of the L-shaped lever 25. Further, in the above illustrated embodiments, the print head 3 of the print tape forming apparatus is provided by the thermal head. However, ink jet type head or laser type head is also available.

What is claimed is:

1. A print tape forming apparatus comprising:

a frame;

feeding means supported to the frame for feeding a tape, the feeding means having a power transmission means rotatable in one direction for feeding the tape in a forward direction for printing, and in opposite direction for feeding the tape in a retracting direction;

printing means supported to the frame for performing a print on the tape when the tape is fed in the forward direction;

cutting means supported to the frame for manually cutting the tape after printing, the cutting means being movable in a cutting direction for cutting the tape, and movable in a non-cutting direction; and means for preventing the cutting means from being moved in the cutting direction when the tape is fed in the forward direction, the preventing means being supported to the frame and connected to the power transmission means and being movable between a first position in accordance with the rotation of the transmission means in the opposite direction for disengagement from the cutting means, and a second position in accordance with rotation of the transmission means in the one direction for engagement with the cutting means.

2. The print tape forming apparatus as claimed in claim 1, wherein the cutting means comprises:

a fixed blade fixed to one end of the frame;

a lever member pivotally supported to the one end of the frame, the lever member being movable in the cutting and non-cutting directions; and a movable blade fixed to the lever member, the lever member being manually angularly movable to move the movable blade toward the fixed blade for cutting the tape and away from the fixed blade for allowing the tape to pass between the fixed and movable blades.

3. The print tape forming apparatus as claimed in claim 2, wherein the feeding means comprises:

a driving motor rotatable in normal and reverse directions;

a gear train drivingly connected to the driving motor and including a plurality of gears successively meshed with each other; and a press roller connected to the gear train and contactable with the tape for feeding the tape in the forward and retracting directions, wherein the power transmission means comprises the gear train.

4. The print tape forming apparatus as claimed in claim 3, wherein the preventing means comprises:

an actuation gear rotatably supported to the frame and meshed with a gear of the gear train;

a stop lever having one end rotatably supported to the frame in concentrical relation to the actuation gear, and another end providing the first and second positions and engageable with the lever member; and urging means interposed between the frame and the stop lever for urging the stop lever toward the actuation gear to provide frictionally integral rotation of the stop lever with the actuation gear.

5. The print tape forming apparatus as claimed in claim 4, wherein the one end of the frame is formed with a recess to provide a first stop wall and a second stop wall, the stop lever being abuttable on the first stop wall for defining the first position of the stop lever when the tape is fed in the retracting direction and being abuttable on the second stop wall for defining the second position of the stop lever when the tape is fed in the forward direction.

6. The print tape forming apparatus as claimed in claim 5, wherein the lever member has a first end portion provided with a push button, an intermediate portion rotatably supported to the one end of the frame, and a second end, and the apparatus further comprising a biasing means connected between the second end of the lever member and the frame for maintaining the movable blade away from the fixed blade.

7. The print tape forming apparatus as claimed in claim 6, wherein the lever member is integrally provided with an engagement piece abuttable on the stop lever when the stop lever is in the second position.

8. The print tape forming apparatus as claimed in claim 7, wherein the printing means comprises:

a print head supported to the frame and a platen rotatably supported to the frame and driven by the gear train for feeding the tape in the forward and retracting direction.

9. The print tape forming apparatus as claimed in claim 3, wherein the preventing means comprises;

a boss member integrally rotatable with a gear of the gear train; and a stop lever having one end frictionally engageable with the boss member and another end providing the first and second positions and engageable with the lever member, the stop lever being pivotally movable in accordance with the rotation of the boss member.

10. The print tape forming apparatus as claimed in claim 9, wherein the one end of the stop lever is provided with a bifurcated portion in contact with the boss member.

11. The print tape forming apparatus as claimed in claim 10, wherein the one end of the frame is formed with a recess to provide a first stop wall and a second stop wall, the stop lever being abuttable on the first stop wall for defining the first position of the stop lever when the tape is fed in the retracting direction and being abuttable on the second stop wall for defining the second position of the stop lever when the tape is fed in the forward direction.

12. The print tape forming apparatus as claimed in claim 11, wherein the lever member has a first end portion provided with a push button, an intermediate portion rotatably supported to the one end of the frame, and a second end, and the apparatus further comprising a biasing means connected between the second end of the lever member and the frame for maintaining the movable blade away from the fixed blade.

13. The print tape forming apparatus as claimed in claim 12, wherein the lever member is integrally provided with an engagement piece abuttable on the stop lever when the stop lever is in the second position.

14. The print tape forming apparatus as claimed in claim 13, wherein the printing means comprises:

a print head supported to the frame; and a platen rotatably supported to the frame and driven by the gear train for feeding the tape in the forward and retracting direction.

* * * * *